US005170634A

United States Patent [19]

Squires

[11] Patent Number: 5,170,634

[45] Date of Patent: Dec. 15, 1992

[54] ACOUSTIC VAPOR TYPE INDICATOR

[75] Inventor: Daniel Squires, Port Huron, Mich.

[73] Assignee: Squires Enterprises, Port Huron, Mich.

[21] Appl. No.: 713,968

[22] Filed: Jun. 11, 1991

[51] Int. Cl.[5] ..... F25B 49/00

[52] U.S. Cl. ..... 62/126; 62/125; 62/475; 62/129; 116/70

[58] Field of Search ..... 62/126, 125, 129, 475, 62/474; 116/70, 67 R; 55/274, 277

[56] References Cited

U.S. PATENT DOCUMENTS 957,663 5/1910 Emslie ..... 116/70

3,933,120 1/1976 Ollis ..... 62/129

*Primary Examiner*—John Sollecito

*Attorney, Agent, or Firm*—Harness, Dickey & Pierce

[57] ABSTRACT

An acoustic vapor type indicator is disclosed in which an audible signal such as a whistle is produced when a vapor is flowing through the indicator. The indicator includes an air chamber having an inlet for connection with a closed vessel containing a quantity of a gas other than air. When the closed vessel is open to the indicator, the gases within the vessel first force the air from the air chamber through an outlet orifice producing a whistle of a first pitch. Once the air has been removed and the gas within the closed vessel passes the outlet orifice, due to a change in density the pitch produced by the indicator will be changed. Alternative embodiments disclose automated pitch detection means as well as a pitch recognition device.

17 Claims, 3 Drawing Sheets

ACOUSTIC VAPOR TYPE INDICATOR

BACKGROUND AND SUMMARY OF THE INVENTION

The present invention pertains to an indicator for producing an audible sound to indicate the type of a vapor passing through the indicator and in particular to a indicator useful for distinguishing between differing gases, especially an unknown vapor and gases commonly found in the atmosphere. The indicator of the present invention, while useful in distinguishing vapors from atmosphere is particularly useful in separating them from refrigerant gases.

It is widely believed today that refrigerants, typically chlorofluorocarbons (CFC), used in vapor compression cooling and heat pump systems have a detrimental effect on the earths' atmospheric ozone layer when the refrigerant is released from a cooling system into the atmosphere. When servicing or repairing a cooling system, it is often first necessary to remove the refrigerant from the cooling system. In the past, refrigerant typically has been released to the atmosphere rather than recovered for later use. The low cost and ready availability of new refrigerant makes it difficult for a service technician to justify the time and expense necessary to recover the refrigerant for later reuse.

However, with the growing concern over the detrimental effect of releasing CFC refrigerants into the atmosphere, new regulations are being passed that prohibit the release of CFC refrigerants into the atmosphere. Rising cost for CFC refrigerants and increased taxation on the production of CFC refrigerants has produced an economic incentive for service technicians to recover the refrigerant rather than releasing it into the atmosphere.

Many refrigerant retrieval devices have been developed in recent years precisely for this purpose. Two such devices are disclosed in Applicant's copending patent applications, Ser. No. 593,689 filed Oct. 5, 1990 and Ser. No. 643,527 filed Jan. 18, 1991. These devices, as well as virtually all other refrigerant retrieval devices, ultimately collect the refrigerant in a closed vessel in which the refrigerant is stored in a steady state condition in which the refrigerant exists as both liquid and vapor. Often times though, a small quantity of non-condensible gas such as air or nitrogen will also be present within the closed vessel. Before returning the recovered refrigerant into the cooling system, it is essential that these non-condensible gases be removed from the closed vessel to avoid the introduction of the non-condensible gases into the cooling system. Typically, the non-condensible gas is removed by opening the closed vessel to allow the gas to vent therefrom. In order to ensure that all of the non-condensible gas is removed, the closed vessel is typically vented longer than necessary with the result that CFC refrigerants are also vented from the closed vessel to the atmosphere. Without rather costly and complex equipment it is impossible for the service technician to ensure that all of the non-condensible gases have been vented without also venting an unknown quantity of the CFC refrigerant as well.

The term "non-condensible" is used in the specification and claims in reference to gases such as air, nitrogen, carbon dioxide, etc which do not condense at ambient temperatures or temperatures experienced in a cooling system cycle as distinguished from refrigerants which are readily condensible at these temperatures.

Accordingly, it is an object of the present invention to provide a vapor type indicator to immediately signal to the technician when all of the non-condensible gases have been vented and that the refrigerant is now being released.

It is a feature of the present invention to provide a device in which the vapor being vented from the closed vessel passes a whistle that will produce an audible signal. The pitch of the signal is a function of the density of the vapor flowing through the device. Due to the density differences between the non-condensible gases present in the closed vessel and the refrigerant vapor, a noticeable difference in pitch can be observed when the gas flowing through the indicator changes from the non-condensible to the refrigerant.

It is a further feature of the present invention to provide a chamber of air that will vent past the whistle first to ensure that initially there will be a gas other than the refrigerant producing the whistle. When the refrigerant is later vented past the whistle, a noticeable change in pitch will occur.

The indicator can be equipped with an electronic pitch detector that electronically detects the change of pitch from the whistle and provides a signal indicating when this has occurred. This embodiment can further be provided with a electronic shut-off valve to stop the flow of vapor from the closed vessel when the pitch change has occurred.

With the appropriate controls for the internal pressure of the closed vessel as well as the temperature of the refrigerant therein, the indicator can be used to determine what type of refrigerant is present. An electronic pitch recognition device is used which not only can distinguish between two different pitches but can determine the frequency of the pitch. With the necessary control for the system pressure and temperature, each refrigerant will produce a different frequency pitch that can be used to determine the type of refrigerant encountered. This is particularly useful in a number of situations.

An example of one such situation is the servicing of a motor vehicle cooling system. Automobile cooling systems are now being produced that use R-134 as a refrigerant rather than the more harmful R-12 refrigerant previously used. When servicing a cooling system it is necessary to ensure that R-12 and R-134 are not mixed together and that when charging a system that the proper type of refrigerant is added to the refrigerant remaining in the system. Previously, it was possible to distinguish between refrigerants by noting the pressure and temperature of the refrigerant and comparing that information to well known charts for each refrigerant. However, R-12 and R-134 produce very similar temperature versus pressure profiles. With a small amount of a non-condensible gas present, it can be impossible to distinguish between these refrigerants without first totally assuming that all non-condensibles have been removed. Furthermore, the pitches produced by these gases vary significantly such that the acoustic vapor indicator of the present invention can with the aid of electronics, be easily used to detect which refrigerant is present.

A further use of a device that can identify the type of refrigerant is in a refrigerant reprocessing facility where a number of storage containers are present and it is necessary to properly identify each refrigerant. To ensure that bottles are not mismarked or in the event a bottle is not marked at all, a simple refrigerant analyzer is required to determine which refrigerant is present before the bottles are emptied.

Alternatively, a microprocessor having preprogrammed information regarding the frequency produced by various refrigerants at a variety of temperatures and pressures can be used to determine the type of refrigerant vapor present. This avoids the need for controlling the temperature and pressure of the refrigerant vapor.

The acoustic vapor type indicator of the present invention provides a simple and easy to use device for detecting the presence of a refrigerant and also the potential to identify the type of refrigerant.

Further objects, features and advantages of the invention will become apparent from a consideration of the following description and the appended claims when taken in connection with the accompanying drawings.

DETAILED DESCRIPTION OF THE INVENTION

Figure 1:
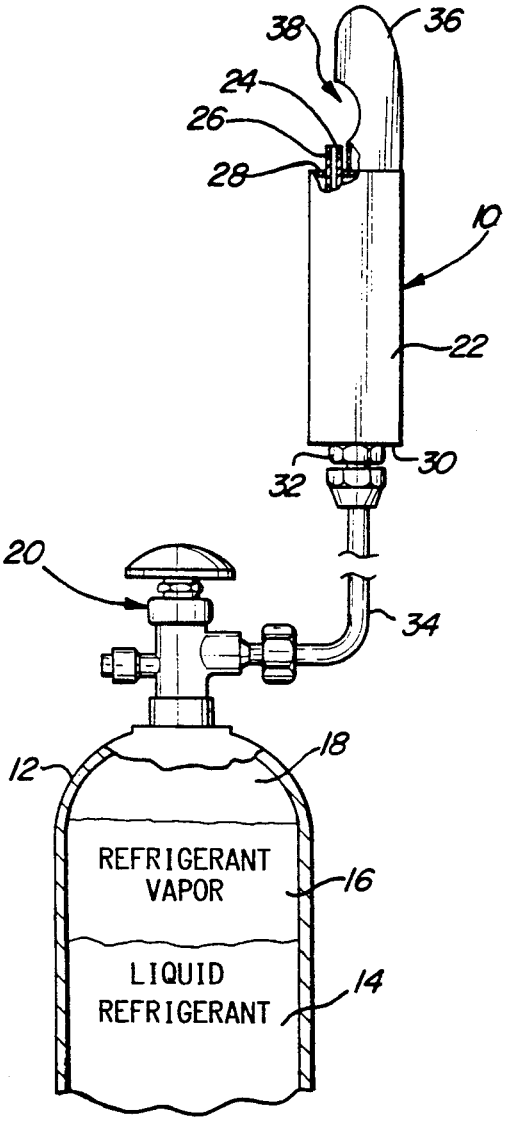
FIG. 1 is a elevational/sectional view of the acoustic vapor type indicator of the present invention connected to a closed vessel containing a refrigerant.

The acoustic vapor type indicator of the present invention is shown in FIG. 1 and designated generally at 10. Indicator 10 is shown connected to a tank or closed vessel 12 containing a quantity of liquid refrigerant 14, refrigerant vapor 16 and a quantity of non-condensible gases 18. The non-condensible gases, having a density less than that of the refrigerant vapor will be found at the top of tank 12.

The tank 12 contains a hand valve 20 at the top thereof for filling or emptying of the tank 12. The tank 12 shown in FIG. 1 is for example only, numerous other tanks can be used as well. Tank 12 is representative of a any closed vessel used to contain a refrigerant such as a tank storing refrigerant retrieved from a cooling system prior to servicing of the system. When it is desired to return the refrigerant to the cooling system, it is necessary to first remove all of the non-condensible gases from the tank 12. This can be accomplished by opening the hand valve 20 to vent the interior of tank 12 to the atmosphere. Current practice results in the tank being vented for an excessive length of time to ensure that the non-condensible gases have been removed. This results in an excessive discharge of the refrigerant from the container 12 into the atmosphere.

The vapor type indicator 10 of the present invention enables the service technician to detect when the gas flowing from tank 12 has changed from the non-condensible gases to the refrigerant after which the technician immediately closes the hand valve 20. Indicator 10 includes a hollow air chamber 22 which is in communication with the ambient atmosphere through outlet orifice 24. Outlet orifice 24 is formed by a small diameter tube 26 disposed in the end wall 28 of the air chamber.

The opposite end wall 30 is equipped with an inlet fitting 32 to enable the indicator 10 to be connected to the tank 12 through a hose or tube 34. Adjacent to the outlet orifice 24 is a hollow echo chamber 36 having an opening 38. The opening 38 is positioned adjacent to the orifice 24 such that gas flowing from the chamber 22 crosses the opening 38 producing an audible whistling sound. The pitch of the whistling sound is a function of the density of the gas. When the valve 20 is initially open, the gas within the tank 12 will flow into the air chamber 22 through the inlet fitting 32 which will force the air within the chamber 22 to exit through the outlet orifice 24. After the air in chamber 22 is vented, the non-condensible gases will flow through the outlet orifice 24. These gases will be similar to if not identical to the air in chamber 22 such that no noticeable difference in pitch will result. However, when the refrigerant vapor begins to flow through the outlet orifice, the change in density will produce a recognizable change in the pitch of the whistling sound. When this change in pitch occurs, the technician knows that the non-condensible gases have been completely removed from the tank. The hand valve 20 is then promptly closed.

The air chamber 22 is used to ensure that there will be at least some volume of non-condensible gas flowing through the outlet orifice so as to produce a first pitch caused by this gas and a recognizable pitch change once the refrigerant vapor begins to flow through the outlet orifice. Without an initial reservoir of air, if the tank 12 did not contain any non-condensible gases, upon opening of the hand valve the refrigerant gases would be the first to flow through the outlet orifice and there would be no subsequent pitch change. Accordingly, the chamber 22 or other means such as the hose 34 containing a volume of air is needed to ensure proper operation of the indicator.

The inlet fitting 32 is preferably located at the opposite end of the air chamber from the outlet orifice 24 to avoid mixing of the air in the chamber with the refrigerant vapor in the tank. By avoiding mixing, there will be a clear distinction in pitch as the gas flowing through the orifice changes from air to non-condensible to refrigerant vapor.

For any given internal pressure in the tank 12, the size of outlet orifice 24 will control the flow of gas through the orifice. For any given orifice size, there will be a optimum range of tank pressures which will produce the proper flow rate to form an audible signal or whistle as the gas flows through the orifice. If the tank pressure is to low or to high, the air flow through the orifice will not be able to produce a whistle sound. Since various tank pressures will be encountered, several different indicators 10 can be provided with the outlet orifices differing in size to enable a technician to utilize the proper size orifice for the tank pressure encountered to produce a whistle sound.

The indicator can be configured in such a manner that the outlet orifice can be changed in size. One embodiment of such a device is shown in FIG. 2 in which the air chamber 22 terminates in a threaded open end 42. The end of the chamber is formed by a threaded end cap 44 with the echo chamber 36 attached thereto. A number of end caps 44 can be provided in which the outlet orifice 24 of each end cap is of a slightly different size to accommodate a wide range of internal tank pressures.

Figure 2A:
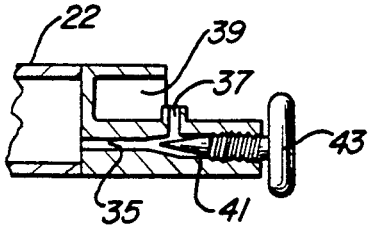
FIG. 2A is a fragmentary view of yet another alternative embodiment of the indicator of the present invention.
Figure 2:
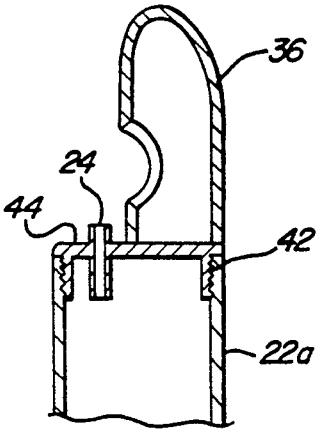
FIG. 2 is a fragmentary sectional view of an alternative embodiment of the indicator of the present invention.

An alternative embodiment is shown in FIG. 2A with provisions for adjusting the flow rate through the outlet orifice. In this embodiment, the vapor flows from the air chamber 22 through a passage 35 to the outlet orifice 37. Orifice 37 is positioned adjacent to echo chamber 39. The flow rate of vapor through the passage 35 and orifice 37 is adjusted by a needle valve 41, the position of which can be adjusted by turning the hand wheel 43. In this manner, the flow of gas through the orifice can be adjusted to compensate for any given internal pressure within the tank 12.

Figure 3:
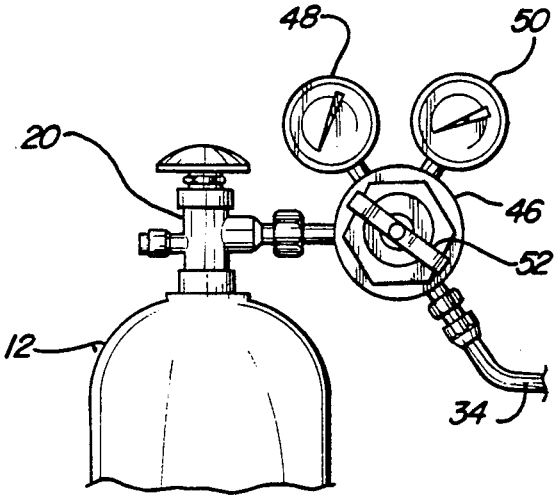
FIG. 3 is an elevational view illustrating a pressure regulator for use in connection with the indicator of the present invention.

The difficulty associated with varying internal tank pressures can also be accommodated by using a single orifice size and including a pressure regulator 46 in the hose 34 as shown in FIG. 3 to provide a predetermined gas pressure to the indicator 10 regardless of the internal pressure in tank 12. The pressure regulator 46 is shown with a cylinder pressure gauge 48 and a testing pressure gauge 50. The testing pressure can be adjusted by rotation of the hand knob 52 to provide the proper pressure for the indicator 10.

Figure 4:
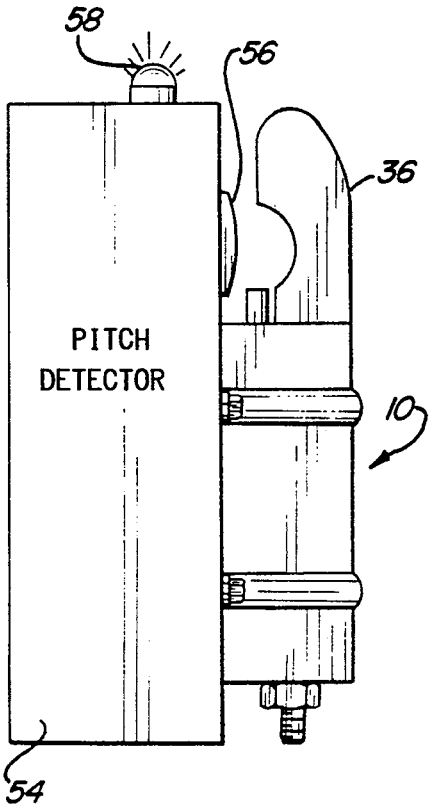
FIG. 4 is an elevational view of an alternative embodiment of the present invention including a pitch detector to automatically signal the change in pitch from the indicator.
Figure 5:
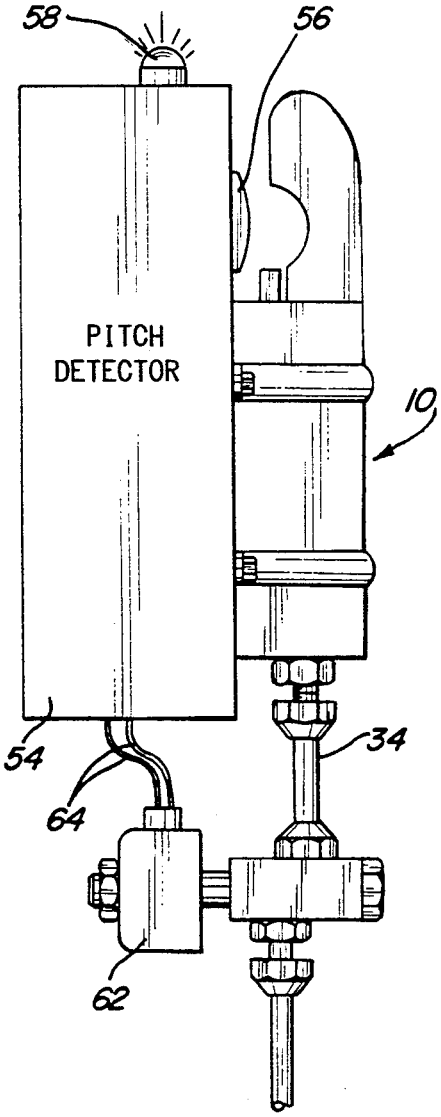
FIG. 5 is a elevational view of the device of FIG. 4 further modified to include an automatic shut-off valve.
Figure 6:
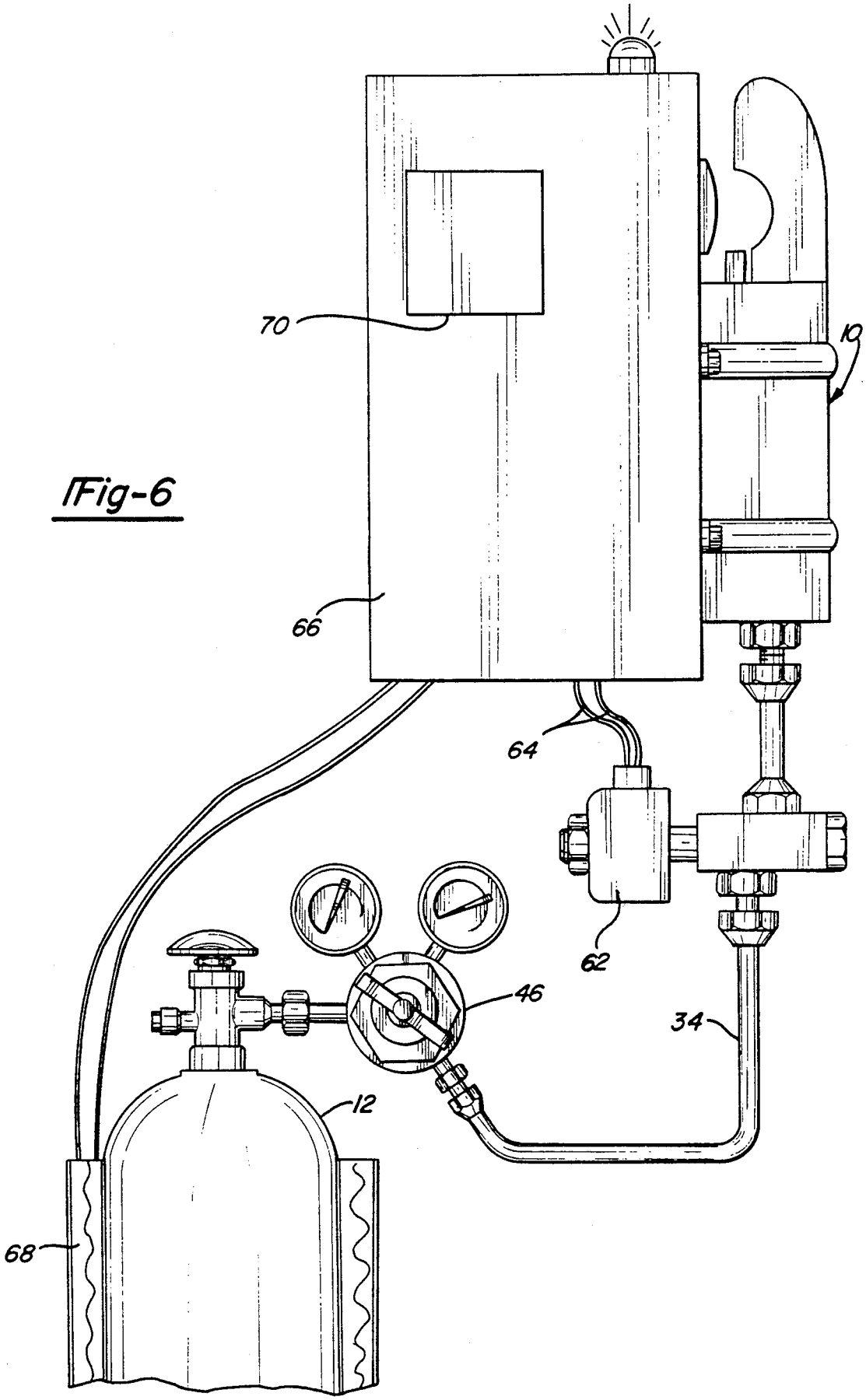
FIG. 6 is an elevational view of another embodiment of the present invention with pitch recognition to enable a determination of the particular refrigerant encountered.

With reference to FIG. 4, the indicator 10 can be equipped with an electronic pitch detector 54 mounted adjacent to the air chamber 22 and the echo chamber 36. The pitch detector 54 includes a microphone 56 positioned adjacent to the echo chamber 36. The detector 54 is equipped with a signaling device such as the light 58 which will illuminate when the pitch of the whistling sound changes as the density of the gas flowing through the outlet orifice changes as the gas changes from the non-condensible gases to the refrigerant vapor. In operation, upon the illuminating of the light 58, the technician would close the hand valve 20 at the top of tank 12.

To automate the device shown in FIG. 4, the hose 34 can be further equipped with a solenoid valve 62 which is normally in an closed position. It is energized into a open position at the beginning of the procedure. When the change in pitch is detected, the detector automatically de-energizes the solenoid to close the valve. Lead wires 64 connect the pitch detector to the solenoid. The light 58 is also provided on the automatic device to provide a signal to the service technician that the pitch change has occurred and the valve 62 is closed. Once the valve 62 has been automatically closed, the service technician manually closes the valve 20 on tank 12 and then disconnects the indicator 10 from the tank.

A more elaborate system can be constructed utilizing an electronic pitch recognition device 66 which is not only able to detect a change in the pitch but can also measure the pitch frequency. By knowing the pitch frequency, it is possible to determine the density of the refrigerant and hence determine which refrigerant is present. In order to do so, the pressure must be controlled. One way of doing so is with the pressure regulator 46. In addition to the vapor pressure, it is also necessary to control the temperature of the refrigerant gas as the temperature will also effect the density of the gas. The temperature can be controlled by providing a blanket heater 68 connected to device 66 by wires 69 to heat the contents of the tank 12. Another way to control the temperature when there are a large quantity of tanks present is to provide a water bath in which the temperature of the water is maintained at a predetermined water temperature. The water bath can be used to heat or control the temperature of a large number of tanks. Preferably, the test temperature will be slightly higher than the ambient temperature so that heating will always be necessary and cooling will never be needed.

The electronic pitch recognition device can be equipped with a visual display 70 to provide the frequency of the pitch or, the device 66 can be equipped with a microprocessor circuit that is preprogrammed to indicate the particular type of refrigerant matched with that frequency. Such a device would also be required to compensate for or accommodate changes in the ambient pressure which varies slightly depending upon the elevation. The ambient pressure will effect the pitch produced by the indicator 10. Preferably, the pitch recognition device 66 will be connected through lead wires 64 to a solenoid valve 62 to automatically stop the flow of refrigerant gas once a refrigerant gas has been detected.

The microprocessor can also be equipped with a memory capacity to store data concerning the pitch frequency of various refrigerants at various temperatures and pressures such that no pressure or temperature control is required to determine the type of refrigerant vapor present as long as the pressure and temperature of the refrigerant vapor are known.

The indicator of the present invention provides a simple and easy to use means for a service technician to discharge non-condensible gases from a closed vessel containing a refrigerant prior to using the refrigerant to recharge a cooling system. The device assures that only an extreme minimal quantity of the refrigerant will be discharged into the atmosphere when the non-condensible gases are removed. By minimizing the quantity of refrigerant gases discharged, the harmful effect on the earth's ozone layer due to discharge of CFC refrigerants can be minimized, and new regulations restricting needless venting of refrigerant can be met.

It is to be understood that the invention is not limited to the exact construction illustrated and described above, but that various changes and modifications may be made without departing from the spirit and scope of the invention as defined in the following claims.

I claim:

1. An acoustic vapor type indicator for use in controlled venting of separated gases from a closed vessel containing a quantity of a separate heavier vapor comprising:

a vapor flow conduit connectable at one end to said closed vessel;

an air chamber connectable to an opposite end of said vapor flow conduit;

an outlet orifice connected to said air chamber; and a hollow echo chamber having an opening positioned adjacent said orifice so that vapor flow through said orifice crosses said opening producing a whistle sound.

2. The indicator of claim 1 further comprising a pressure regulator in said conduit to control the pressure of vapor flowing through said orifice.

3. The indicator of claim 2 comprising electronic pitch detection means for indicating a change in pitch as the vapor flowing through said orifices changes from a non-condensible gas to said separate heavier vapor.

4. The indicator of claim 3 wherein said conduit includes an electronically controlled shut off valve operable to close in response to a signal from said electronic pitch detection means.

5. The indicator of claim 2 further comprising:

means for regulating the temperature of the gas in said closed vessel to provide the gas with a predetermined temperature; and electronic pitch recognition means for indicating the frequency of said sound whereby condensible vapor can be indicated.

6. An acoustic vapor type indicator for use in venting non-condensible gases from a closed vessel containing a quantity of a condensible refrigerant vapor comprising:

a chamber having a quantity of air therein;

a chamber inlet adapted to connect said chamber to said closed vessel;

said chamber forming an outlet orifice substantially opposite said inlet, whereby as refrigerant vapor enters said chamber through said inlet, air in said chamber exits through said outlet orifice substantially before said refrigerant vapor exits through said outlet orifice, said outlet orifice communicating with ambient air;

means adjacent said orifice responsive to a flow of gas through said orifice for producing an audible sound, the pitch of said sound being a function of the density of said gas whereby when the air is flowing through said orifice, a first pitch is produced and when said refrigerant vapor is flowing through said orifice a second pitch different from said first pitch is produced.

7. The indicator of claim 6 wherein said pitch producing means includes a hollow echo chamber forming an opening, said outlet orifice producing a flow of gas across said opening to produce said pitch.

8. The indicator of claim 6 further comprising coupling means for connecting said inlet to said closed vessel, said coupling means including a pressure regulator to control the pressure of gas flowing through said inlet into said air chamber.

9. The indicator of claim 6 further comprising electronic pitch detection means for indicating the change from said first pitch to said second pitch.

10. The indicator of claim 8 further comprising electronic pitch detection means for indicating the change from said first pitch to said second pitch.

11. The indicator of claim 10 wherein said coupling means includes an electronically controlled shut off valve operable to close in response to a signal from said electronic pitch detection means.

12. The indicator of claim 8 further comprising:

means for regulating the temperature of vapor in said closed vessel to provide vapor with a predetermined temperature; and electronic pitch recognition means for indicating the frequency of said second pitch whereby the refrigerant vapor can be identified.

13. The indicator of claim 6 further comprising:

pitch recognition means for indicating the frequency of said second pitch; and microprocessor means for determining the type of refrigerant vapor flowing through said outlet orifice based on the pitch frequency, vapor pressure and vapor temperature.

14. An acoustic vapor type indicator for use in determining the type of a condensible refrigerant contained in a closed vessel comprising:

a chamber having a quantity of air therein;

an inlet at one end of said chamber;

an outlet orifice at an opposite end of said chamber from said inlet;

an echo chamber having an opening positioned adjacent said outlet orifice whereby gas flowing through said outlet orifice travels over said opening to produce a sound;

means for connecting said inlet to said closed vessel, said connecting means including a pressure regulator to provide refrigerant vapor to said chamber at a predetermined pressure;

means for controlling the temperature of the refrigerant in the closed vessel at a predetermined temperature; and pitch recognition means for determining the frequency of sound produced as said refrigerant vapor flows past said opening and for displaying said frequency.

15. The indicator of claim 14 further comprising a valve in said connecting means operable to close said connecting means after ascertainment that said frequency of sound produced is that frequency generated by said refrigerant vapor flowing past said opening.

16. The indicator of claim 14 further comprising microprocessor means for determining the type of refrigerant vapor flowing through said outlet orifice based on the sound frequency, pressure and temperature of said refrigerant.

17. An acoustic vapor type indicator for use in controlled venting of separated gases from a closed vessel containing a quantity of a separate heavier vapor comprising:

a vapor flow conduit connectable at one end to said closed vessel;

a pressure regulator in said conduit to control the pressure of vapor flowing through said orifice;

an outlet orifice at the opposite end of said conduit;

a hollow echo chamber having an opening positioned adjacent said orifice so that vapor flow through said orifice crosses said opening producing a whistle sound;

means for regulating the temperature of the gas in said closed vessel to provide the gas with a predetermined temperature; and electronic pitch recognition means for indicating the frequency of said sound whereby condensible vapor can be indicated.

* * * * *